US010804007B1

(12) United States Patent
Abe

(10) Patent No.: US 10,804,007 B1
(45) Date of Patent: Oct. 13, 2020

(54) FLAT CONDUCTOR WIRE

(71) Applicant: YAZAKI CORPORATION, Tokyo (JP)

(72) Inventor: Noriyuki Abe, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/824,610

(22) Filed: Mar. 19, 2020

(30) Foreign Application Priority Data

Apr. 23, 2019 (JP) ..... 2019-081560

(51) Int. Cl.
*H01B 7/00* (2006.01)
*H01B 7/08* (2006.01)
*H01B 1/02* (2006.01)

(52) U.S. Cl.
CPC ..... *H01B 7/08* (2013.01); *H01B 1/023* (2013.01)

(58) Field of Classification Search
CPC ... H01B 7/02; H01B 7/04; H01B 7/06; H01B 7/08; H01B 1/023; H01B 11/02; H01B 11/04
USPC ..... 174/110 R, 117 R, 117 F, 117 FF
See application file for complete search history.

(56) References Cited

U.S. PATENT DOCUMENTS 7,073,255 B1 * 7/2006 Swanson ..... H01B 7/0823 156/52
2003/0236020 A1 * 12/2003 Iamartino ..... H01R 13/562 439/445
2011/0088945 A1 * 4/2011 Yanagimoto ..... H05K 1/028 174/72 A
2013/0175081 A1 * 7/2013 Watanabe ..... H01B 11/18 174/363
2014/0124257 A1 * 5/2014 Yoshihara ..... H05K 1/023 174/350
2014/0360756 A1 12/2014 Honda et al.
2015/0021067 A1 * 1/2015 Muto ..... H01B 3/307 174/110 SR
2016/0055940 A1 * 2/2016 Oya ..... H01B 3/303 174/110 SR
2019/0214542 A1 * 7/2019 Yoshida ..... G01L 1/16

FOREIGN PATENT DOCUMENTS

JP 2014-238927 A 12/2014
JP 2016-76316 A 5/2016
JP 2018-160317 A 10/2018

* cited by examiner

*Primary Examiner* — William H. Mayo, III
(74) *Attorney, Agent, or Firm* — Kenealy Vaidya LLP

(57) ABSTRACT

A flat conductor wire includes a flat conductor made of aluminum containing inevitable impurities. A cross section of the flat conductor orthogonal to a longitudinal direction of the flat conductor has a rounded corner portion, a radius of curvature of the corner portion being equal to or greater than one fourth of a thickness of the cross section of the flat conductor. A width of the cross section of the flat conductor is equal to or smaller than $60\varepsilon/(1-\varepsilon)$, $\varepsilon$ being a uniform elongation of the flat conductor.

2 Claims, 4 Drawing Sheets

FIG. 4A

Without curvature THICKNESS = 2.0 mm

| | WIDTH (mm) | UNIFORM ELONGATION (%) | MINIMUM BEND RADIUS (mm) |
|---|---|---|---|
| COMPARATIVE EXAMPLE 2 | 35.0 | 38.2 | 28.3 |
| COMPARATIVE EXAMPLE 3 | 37.5 | 38.2 | 30.3 |
| COMPARATIVE EXAMPLE 4 | 40.0 | 38.2 | 32.4 |
| COMPARATIVE EXAMPLE 5 | 42.5 | 38.2 | 34.4 |

FIG. 4B

Radius of curvature = 0.5mm THICKNESS = 2.0 mm

| | WIDTH (mm) | UNIFORM ELONGATION (%) | MINIMUM BEND RADIUS (mm) |
|---|---|---|---|
| EXAMPLE 2 | 35.0 | 40.8 | 25.4 |
| EXAMPLE 3 | 37.5 | 40.8 | 27.2 |
| EXAMPLE 4 | 40.0 | 40.8 | 29.0 |
| COMPARATIVE EXAMPLE 6 | 42.5 | 40.8 | 30.8 |

FIG. 4C

Radius of curvature = 0.8mm THICKNESS = 2.0 mm

| | WIDTH (mm) | UNIFORM ELONGATION (%) | MINIMUM BEND RADIUS (mm) |
|---|---|---|---|
| EXAMPLE 5 | 35.0 | 41.2 | 24.9 |
| EXAMPLE 6 | 37.5 | 41.2 | 26.7 |
| EXAMPLE 7 | 40.0 | 41.2 | 28.5 |
| COMPARATIVE EXAMPLE 7 | 42.5 | 41.2 | 30.3 |

FIG. 4D

Radius of curvature = 1.0 mm THICKNESS = 2.0 mm

| | WIDTH (mm) | UNIFORM ELONGATION (%) | MINIMUM BEND RADIUS (mm) |
|---|---|---|---|
| EXAMPLE 8 | 35.0 | 41.3 | 24.9 |
| EXAMPLE 9 | 37.5 | 41.3 | 26.7 |
| EXAMPLE 10 | 40.0 | 41.3 | 28.5 |
| COMPARATIVE EXAMPLE 8 | 42.5 | 41.3 | 30.2 |

FLAT CONDUCTOR WIRE

CROSS-REFERENCE TO RELATED APPLICATION

The present application claims priority to Japanese Patent Application No. 2019-081560 filed on Apr. 23, 2019, the entire content of which is incorporated herein by reference.

BACKGROUND

The present invention relates to a flat conductor wire.

A related art electric wire employs aluminum as a conductor for the purpose of reducing the weight of the electric wire. In order to save space when being routed in a vehicle or the like, the conductor may have a cross section of a flat or rectangular shape as a flat conductor wire (see, for example, JP2014-238927A, JP2016-76316A, and JP2018-160317A).

However, when the related art electric wire is bent within a planar direction of the flat conductor to be routed in accordance with the shape of the vehicle or the like, a stress is likely to be locally applied to a corner portion of the flat conductor, resulting in a crack at the corner portion.

SUMMARY

Illustrative aspects of the present invention provide a flat conductor wire that can prevent occurrence of a crack with a bend within a planar direction.

According to an illustrative aspect of the present invention, a flat conductor wire includes a flat conductor made of aluminum containing inevitable impurities. A cross section of the flat conductor orthogonal to a longitudinal direction of the flat conductor has a rounded corner portion, a radius of curvature of the corner portion being equal to or greater than one fourth of a thickness of the cross section of the flat conductor. A width of the cross section of the flat conductor is equal to or smaller than $60\varepsilon/(1-\varepsilon)$, $\varepsilon$ being a uniform elongation of the flat conductor.

Other aspects and advantages of the invention will be apparent from the following description, the drawings and the claims.

BRIEF DESCRIPTION OF THE DRAWINGS

FIG. 4 is a table illustrating a correlation among a width of the cross section of the flat conductor, uniform elongation, and a minimum bend radius of the flat conductor, in which FIG. 4A illustrates a case where the conductor corner portion are not rounded and the uniform elongation is 38.2%. FIG. 4B illustrates a case where the conductor corner portion is rounded with a radius of curvature being 0.5 mm and the uniform elongation is 40.8%, FIG. 4C illustrates a case where the conductor corner portion is rounded with the radius of curvature being 0.8 mm and the uniform elongation is 41.2%, and FIG. 4D illustrates a case where the conductor corner portion is rounded with the radius of curvature being 1.0 mm and the uniform elongation is 41.3%.

DETAILED DESCRIPTION

Hereinafter, exemplary embodiments of the present invention will be described in detail with reference to the drawings.

The present invention is not limited to the embodiment to be described below and may be appropriately changed without departing from the spirit of the present invention. In the embodiment described below, some configurations are not shown or described, but it goes without saying that a known or well-known technique is applied as appropriate to details of an omitted technique within a range in which no contradiction occurs to contents described below.

Figure 1:
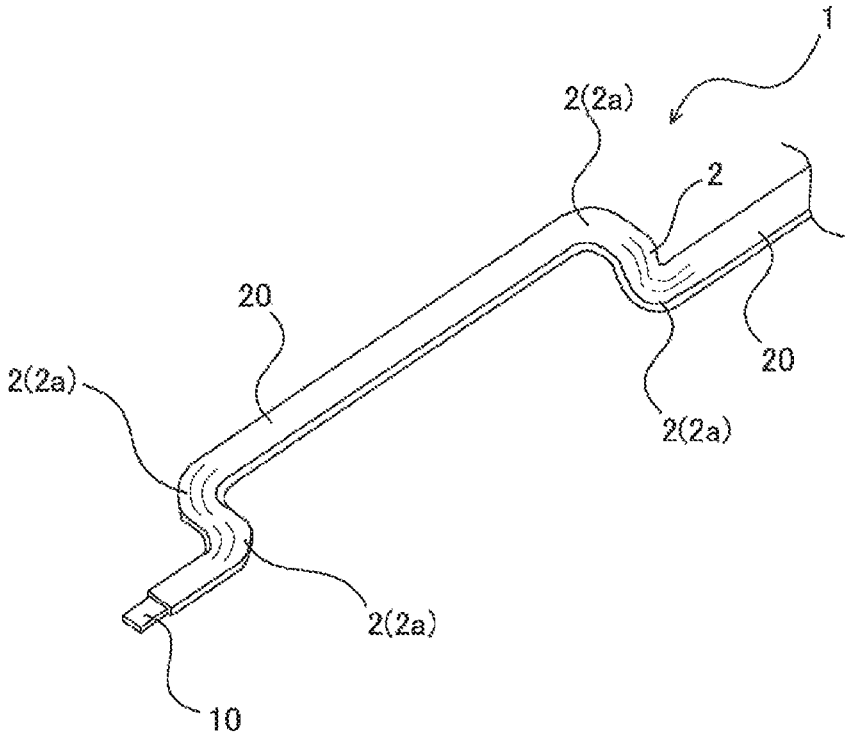
FIG. 1 is a perspective view illustrating a flat conductor wire according to an embodiment of the present invention.
Figure 2:
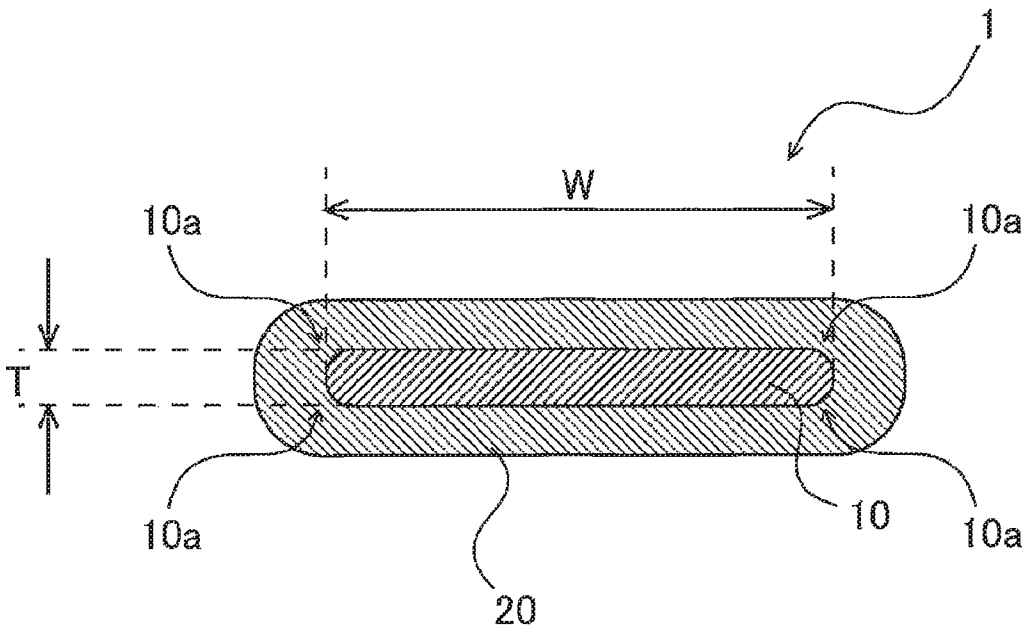
FIG. 2 is a cross-sectional view illustrating the flat conductor wire according to the embodiment of the present invention.

FIG. 1 is a perspective view illustrating a flat conductor wire according to the embodiment of the present invention. FIG. 2 is a cross-sectional view illustrating the flat conductor wire according to the embodiment of the present invention. As illustrated in FIGS. 1 and 2, a flat conductor wire 1 according to the present embodiment is to be routed as a wire harness to be used in, for example, a vehicle, and includes a flat conductor 10 and an insulation coating 20.

The flat conductor wire 1 is to be routed in, for example, a vehicle, and includes a bent portion 2 having a predetermined bend radius. A portion 2*a* of the bent portion 2 is bent within a planar direction of the flat conductor 10, i.e., bent within a plane parallel to the flat surface of the flat conductor 10.

The flat conductor 10 is made of aluminum containing inevitable impurities (e.g., pure aluminum such as A1050 to A1100 having a purity of 99.00% or more). Such a flat conductor 10 is subjected to an O material treatment defined by JISH0001, for example, and has an improved uniform elongation as compared to a case where the O material treatment is not performed.

The insulation coating 20 is provided as an insulator covering an outer periphery of the flat conductor 10. The insulation coating 20 is made of, for example, polypropylene (PP), polyethylene (PE), and poly vinyl chloride (PVC).

In the flat conductor 10 according to the present embodiment, a cross section of the flat conductor 10 orthogonal to a longitudinal direction of the flat conductor 10 has a rounded corner portion 10*a*, a radius of curvature of the corner portion 10*a* being equal to or greater than one fourth of a thickness T (plate thickness T) of the cross section of the flat conductor 10. For example, when the plate thickness T of the flat conductor 10 is 2 mm, the radius of curvature of the conductor corner portion 10*a* is equal to or greater than 0.5 mm. When a predetermined curvature is provided for the conductor corner portion 10*a* as described above, in other words, when the conductor corner portion 10*a* is rounded or curved in the cross sectional view, a portion of the flat conductor 10, the portion being subject to a locally concentrated stress and a crack, is removed. Consequently, the uniform elongation of the flat conductor 10 can be improved.

In addition, in the flat conductor 10 according to the present embodiment, when the radius of curvature of the conductor corner portion 10*a* is equal to or greater than one fourth of the plate thickness T, a plate width W (width W) of the cross section of the flat conductor 10 is equal to or smaller than $60\varepsilon/(1-\varepsilon)$, $\varepsilon$ being the uniform elongation of the flat conductor 10, i.e., $W \leq 60\varepsilon/(1-\varepsilon)$. When a condition defined with this expression $W \leq 60\varepsilon/(1-\varepsilon)$ is satisfied, a crack does not occur even when the bent portion 2*a* is bent with a bend radius of 30 mm.

When the radius of curvature of the conductor corner portion 10*a* is not equal to or greater than one fourth of the plate thickness T or when the curvature is not provided, i.e., when the conductor corner portion 10*a* is not rounded, in the flat conductor 10 that is made of pure aluminum having uniform elongation being equal to or greater than 38.2%, a limit value of the plate width W at which a crack does not occur with a bend radius of 30 mm is 37.09 mm, based on $W \leq 60\varepsilon/(1-\varepsilon)$ (Expression 1). However, in the flat conductor 10 according to the present embodiment, since the radius of curvature of the conductor corner portion 10*a* is equal to or greater than one fourth of the plate thickness T, the uniform elongation 6 is improved up to 40.8%. As a result, a crack does not occur with a bend of a bend radius of 30 mm and with the plate width W being 41.3 mm.

Furthermore, in the flat conductor 10 according to the present embodiment, the plate width W is preferably set to be $W > 60\varepsilon'/(1-\varepsilon')$ (Expression 2). ε' being the uniform elongation in a case where there is no curvature at the conductor corner portion 10*a*, i.e., when the conductor corner portion 10*a* is not rounded. That is, in the flat conductor 10 made of pure aluminum having the uniform elongation ε' being equal to or greater than 38.2%, the plate width W is preferably greater than 37.09 mm. Accordingly, with the radius of curvature of the conductor corner portion 10*a* being equal to or greater than one fourth of the plate thickness T, the flat conductor 10 with plate width W does not crack even when the flat conductor 10 is bent at the bend radius of 30 mm.

Figure 3:
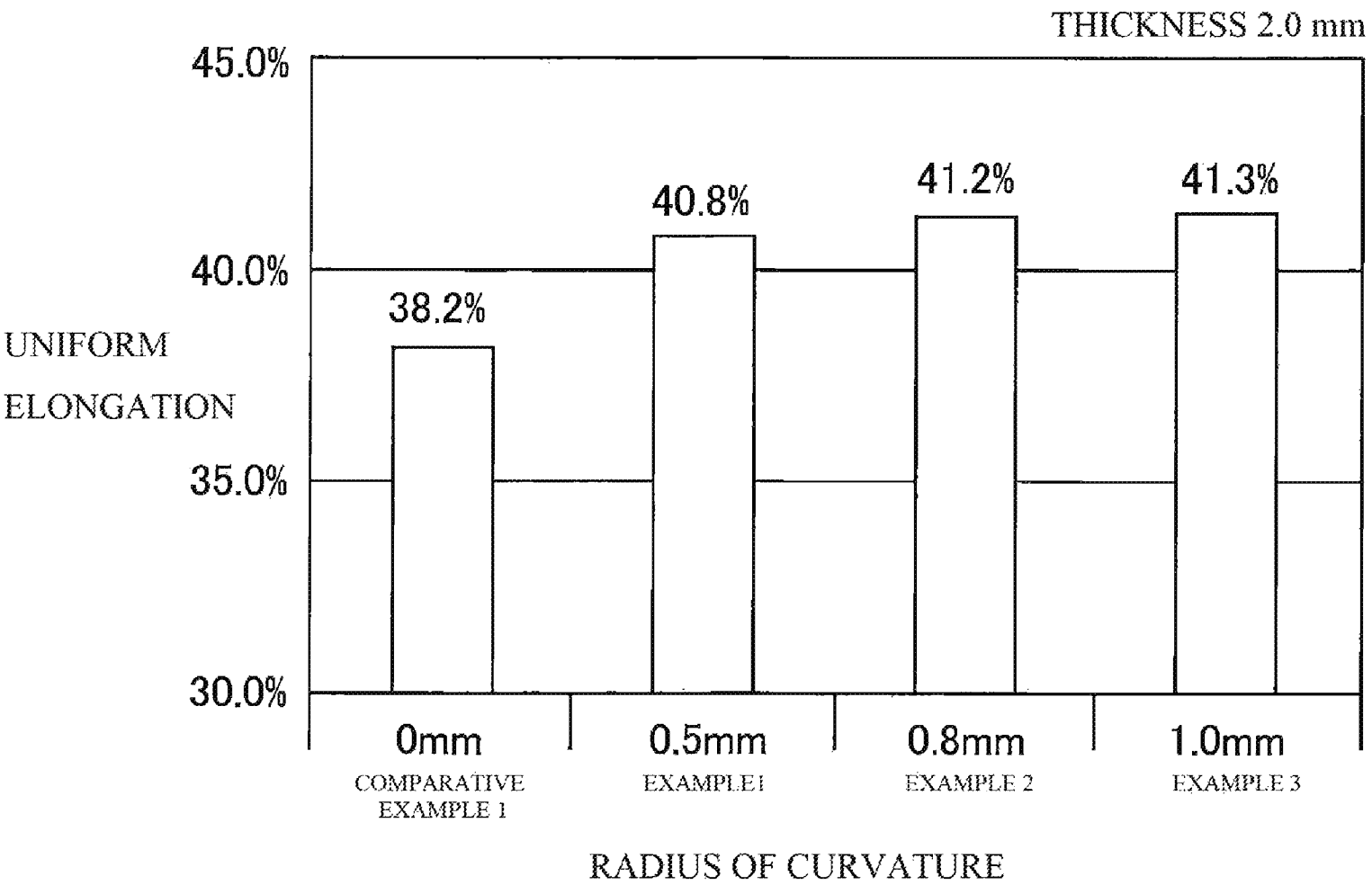
FIG. 3 is a graph illustrating a correlation between uniform elongation of a flat conductor and a radius of curvature at a conductor corner portion.

Next, examples and comparative examples of the present invention will be described. FIG. 3 is a graph illustrating a correlation between uniform elongation of a flat conductor and a radius of curvature at a conductor corner portion.

Flat conductors according to Examples 1 to 3 and Comparative Example 1 is made of pure aluminum having uniform elongation of 38.2%, and in Examples 1 to 3, the conductor corner portion is rounded using a predetermined method. A plate width of the flat conductors is 20 mm.

As illustrated in FIG. 3, in Comparative Example 1 in which there was no curve (curvature) at the conductor corner portion, the uniform elongation was 38.2%. In contrast, in Example 1 in which the radius of curvature at the conductor corner portion was set to be one fourth of the plate thickness, the uniform elongation was improved to 40.8%. Similarly, in Example 2 in which the radius of curvature was set to be two fifth of the plate thickness, the uniform elongation was improved to 41.2%. Further, in Example 3 in which the radius of curvature was set to be one half of the plate thickness, the uniform elongation was improved to 41.3%.

As described above, it was found that the uniform elongation improves by providing a curve (curvature) at the conductor corner portion, i.e., by rounding the conductor corner portion. It can be inferred that this is because a portion where a crack is likely to occur is removed.

Further, it was found that when the radius of curvature at the conductor corner portion is in a range of being equal to or greater than two fifth of the plate thickness, there is little difference in increase of the uniform elongation. That is, it was also found that if the radius of curvature at the conductor corner portion is set to be equal to or greater than two fifth of the plate thickness, the increase of the uniform elongation can be substantially maximized.

FIG. 4 is a table illustrating a correlation among a width of the cross section of the flat conductor, uniform elongation, and a minimum bend radius of the flat conductor, in which FIG. 4A illustrates a case where the conductor corner portion is not rounded and the uniform elongation is 38.2%, and FIG. 4B illustrates a case where the conductor corner portion is rounded with a radius of curvature being 0.5 mm and the uniform elongation is 40.8%. Further, FIG. 4C illustrates a case where the conductor corner portion is rounded with the radius of curvature being 0.8 mm and the uniform elongation is 41.2%, and FIG. 4D illustrates a case where the conductor corner portion is rounded with the radius of curvature being 1.0 mm and the uniform elongation is 41.3%. The flat conductors illustrated in FIG. 4 have the same plate thickness of 2.0 mm.

As illustrated in FIG. 4A, a flat conductor illustrated in Comparative Example 2 has a plate width of 35.0 mm. When the flat conductor having this plate width is bent in a planar direction, a minimum bend radius (a minimum value of the radius of curvature at which a crack does not occur) is 28.3 mm. Therefore, in the flat conductor according to Comparative Example 2, a crack does not occur with bending of a bend radius of 30 mm.

A flat conductor illustrated in Comparative Example 3 has a plate width of 37.5 mm. A minimum bend radius of the flat conductor having this plate width is 30.3 mm. Therefore, in the flat conductor according to Comparative Example 3, a crack occurs with bending of a bend radius of 30 mm. Similarly, a flat conductor illustrated in Comparative Example 4 has a plate width of 40.0 mm and a minimum bend radius of 32.4 mm. A flat conductor illustrated in Comparative Example 5 has a plate width of 42.5 mm and a minimum bend radius of 34.4 mm. Therefore, in the flat conductors according to Comparative Examples 4 and 5, a crack occurs with bending of a bend radius of 30 mm.

For the flat conductor having uniform elongation of 38.2%, the plate width at the minimum bend radius of 30 mm is 37.09 mm.

In the example illustrated in FIG. 4B, the conductor corner portion is rounded with the radius of curvature being 0.5 mm, and the uniform elongation is increased to 40.8%. A flat conductor illustrated in Example 2 has a plate width of 35.0 mm. When the flat conductor having this plate width is bent in a planar direction, the minimum bend radius is 25.4 mm. Therefore, in the flat conductor according to Example 2, a crack does not occur with bending of a bend radius of 30 mm (a plate width of Example 2 satisfies a condition indicated by Expression (1), and thus a crack does not occur with bending of a bend radius of 30 mm).

A flat conductor illustrated in Example 3 has a plate width of 37.5 mm and a minimum bend radius of 27.2 mm. A flat conductor illustrated in Example 4 has a plate width of 40.0 mm and a minimum bend radius of 29.0 mm. Therefore, in the flat conductors according to Examples 3 and 4, a crack does not occur with bending of a bend radius of 30 mm (the plate widths of Examples 3 and 4 satisfy the condition indicated by Expression (1) and further a condition indicated by Expression (2), and thus a crack does not occur with bending of a bend radius of 30 mm).

Meanwhile, a flat conductor illustrated in Comparative Example 6 has a plate width of 42.5 mm and a minimum bend radius of 30.8 mm. Therefore, in the flat conductor according to Comparative Example 6, a crack occurs with bending of a bend radius of 30 mm (the plate width of Comparative Example 6 does not satisfy the condition indicated by Expression (1), and a crack occurs with bending of a bend radius of 30 mm).

For a flat conductor having such uniform elongation of 40.8%, the plate width at the minimum bend radius of 30 mm is 41.3 mm.

In the example illustrated in FIG. 4C, the conductor corner portion is rounded with the radius of curvature being 0.8 mm, and the uniform elongation is increased to 41.2%.

A flat conductor illustrated in Example 5 has a plate width of 35.0 mm. When the flat conductor having this plate width is bent in a planar direction, the minimum bend radius is 24.9 mm. Therefore, in the flat conductor according to Example 5, a crack does not occur with bending of a bend radius of 30 mm (the plate width of Example 5 satisfies the condition indicated by Expression (1), and a crack does not occur with bending of a bend radius of 30 mm).

A flat conductor illustrated in Example 6 has a plate width of 37.5 mm and a minimum bend radius of 26.7 mm. A flat conductor illustrated in Example 7 has a plate width of 40.0 mm and a minimum bend radius of 28.5 mm. Therefore, in the flat conductors according to Examples 6 and 7, a crack does not occur with bending of a bend radius of 30 mm (the plate widths of Examples 6 and 7 satisfy the condition indicated by Expression (1) and further the condition indicated by Expression (2), and thus a crack does not occur with bending of a bend radius of 30 mm).

A flat conductor illustrated in Comparative Example 7 has a plate width of 42.5 mm and a minimum bend radius of 30.3 mm. Therefore, in the flat conductor according to Comparative Example 7, a crack occurs with bending of a bend radius of 30 mm (the plate width of Comparative Example 7 does not satisfy the condition indicated by Expression (1), and therefore a crack occurs with bending of a bend radius of 30 mm).

For a flat conductor having such uniform elongation of 41.2%, the plate width at the minimum bend radius of 30 mm is 42.1 mm.

In the example illustrated in FIG. 4D, the conductor corner portion is rounded with the radius of curvature being 1.0 mm, and the uniform elongation is increased to 41.3%. A flat conductor illustrated in Example 8 has a plate width of 35.0 mm. When the flat conductor having this plate width is bent in a planar direction, the minimum bend radius is 24.9 mm. Therefore, in the flat conductor according to Example 8, a crack does not occur with bending of a bend radius of 30 mm (the plate width of Example 8 satisfies the condition indicated by Expression (1), and a crack does not occur with bending of a bend radius of 30 mm).

A flat conductor illustrated in Example 9 has a plate width of 37.5 mm and a minimum bend radius of 26.7 mm. A flat conductor illustrated in Example 10 has a plate width of 40.0 mm and a minimum bend radius of 28.5 mm. Therefore, in the flat conductors according to Examples 9 and 10, a crack does not occur with bending of a bend radius of 30 mm (the plate widths of Examples 9 and 10 satisfy the condition indicated by Expression (1) and further the condition indicated by Expression (2), and a crack does not occur with bending of a bend radius of 30 mm).

A flat conductor illustrated in Comparative Example 8 has a plate width of 42.5 mm and a minimum bend radius of 30.2 mm. Therefore, in the flat conductor according to Comparative Example 8, a crack occurs with bending of a bend radius of 30 mm (the plate width of Comparative Example 8 does not satisfy the condition indicated by Expression (1), and therefore a crack occurs with bending of a bend radius of 30 mm).

For a flat conductor having such uniform elongation of 41.3%, the plate width at the minimum bend radius of 30 mm is 42.2 mm.

From the above, it was found that when the radius of curvature at the conductor corner portion is equal to or greater than one fourth of the plate thickness in the flat conductor made of pure aluminum having uniform elongation being equal to or greater than 38.2%, a crack does not occur with bending of a bend radius of 30 mm and with the plate width being 41.3 mm, based on Expression (1).

It was also found that, although not illustrated, even when the plate width was fixed and the plate thickness was changed, the minimum bend radius did not change. Therefore, the plate thickness may be of any value.

According to an aspect of the embodiments described above, a flat conductor wire (1) includes a flat conductor (10) made of aluminum containing inevitable impurities. A cross section of the flat conductor (10) orthogonal to a longitudinal direction of the flat conductor (10) has a rounded corner portion (10*a*), a radius of curvature of the corner portion (10*a*) being equal to or greater than one fourth of a thickness of the cross section of the flat conductor (10). A width of the cross section of the flat conductor (10) is equal to or smaller than $60\varepsilon/(1-\varepsilon)$, $\varepsilon$ being a uniform elongation of the flat conductor (10).

According to the flat conductor wire having the above-described configuration, with the radius of curvature at the conductor corner portion 10*a* being equal to or greater than one fourth of the plate thickness T, the conductor corner portion 10*a* where a crack is likely to occur is removed. As a result, the possibility that the crack occurs at the conductor corner portion 10*a* is lowered. In particular, with the radius of curvature at the conductor corner portion 10*a* being equal to or greater than one fourth of the plate thickness T, the plate width W is $W \leq 60\varepsilon/(1-\varepsilon)$, $\varepsilon$ being the uniform elongation of the flat conductor 10. When the condition defined by this expression is satisfied, occurrence of a crack due to bending with a radius of curvature of 30 mm can be prevented. Therefore, it is possible to provide the flat conductor wire 1 that can prevent the occurrence of a crack with bending of a bend radius of 30 mm in the planar direction. When mounting a flat conductor wire on a vehicle or the like, the flat conductor wire is bent in a planar direction typically with a bend radius of about 30 mm.

The flat conductor (10) may be provided by rounding a corner portion having no curvature. The width of the cross section of the flat conductor may be greater than $60\varepsilon'/(1-\varepsilon')$, $\varepsilon'$ being a uniform elongation of the flat conductor before the corner portion is rounded.

With this configuration, the plate width W is $W > 60\varepsilon'/(1-\varepsilon')$, $\varepsilon'$ being a uniform elongation of the flat conductor 10 before the corner portion 10*a* is rounded. As long as the plate width W satisfies the condition of $W > 60\varepsilon'/(1-\varepsilon')$, a crack does not occur even with bending of a bend radius of 30 mm in the planar direction, which cannot be possible in a flat conductor having no curvature at the conductor corner portion 10*a*.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

For example, the flat conductor wire 1 according to the present embodiment may be used as a power supply wire of a vehicle using a high voltage such as an electric vehicle or a hybrid vehicle. However, the present invention is not limited thereto, and may be used for other types of vehicles, other devices, or the like. Further, the present invention is not limited to be used as a power supply wire, but may also be used in other applications such as a signal wire.

Further, an example in which the flat conductor 10 is made of pure aluminum having uniform elongation of 38.2% is described in the above embodiment. However, the present invention is not limited thereto, and the uniform elongation of pure aluminum forming the flat conductor 10 is not limited to 38.2%.

What is claimed is:

1. A flat conductor wire comprising a flat conductor made of aluminum containing inevitable impurities, wherein a cross section of the flat conductor orthogonal to a longitudinal direction of the flat conductor has a rounded corner portion, a radius of curvature of the corner portion being equal to or greater than one fourth of a thickness of the cross section of the flat conductor, and wherein a width of the cross section of the flat conductor is equal to or smaller than $60\varepsilon/(1-\varepsilon)$, $\varepsilon$ being a uniform elongation of the flat conductor.

2. The flat conductor wire according to claim 1, wherein the flat conductor is provided by rounding a corner portion having no curvature, and wherein the width of the cross section of the flat conductor is greater than $60\varepsilon'/(1-\varepsilon')$, $\varepsilon'$ being a uniform elongation of the flat conductor before the corner portion is rounded.

* * * * *